US011725406B2

(12) United States Patent
Chen et al.

(10) Patent No.: US 11,725,406 B2
(45) Date of Patent: Aug. 15, 2023

(54) SPRAYING SYSTEM AND USING METHOD THEREOF

(71) Applicant: KENMEC MECHANICAL ENGINEERING CO., LTD., Taipei (TW)

(72) Inventors: Yu-Jen Chen, Taipei (TW); Chun-Jen Lin, Taipei (TW); Chia-Hui Huang, Taipei (TW)

(73) Assignee: KENMEC MECHANICAL ENGINEERING CO., LTD., Taipei (TW)

( * ) Notice: Subject to any disclaimer, the term of this patent is extended or adjusted under 35 U.S.C. 154(b) by 0 days.

(21) Appl. No.: 17/377,397

(22) Filed: Jul. 16, 2021

(65) Prior Publication Data

US 2022/0042332 A1 Feb. 10, 2022

Related U.S. Application Data

(60) Provisional application No. 63/062,892, filed on Aug. 7, 2020.

(30) Foreign Application Priority Data

Apr. 20, 2021 (TW) ..... 110114216

(51) Int. Cl.

| | |
|---|---|
| ***B05B 15/62*** | (2018.01) |
| ***B05B 15/68*** | (2018.01) |
| ***E04G 23/00*** | (2006.01) |
| *B05B 12/12* | (2006.01) |

(52) U.S. Cl.

CPC ..... *E04G 23/002* (2013.01); *B05B 15/62* (2018.02); *B05B 15/68* (2018.02); *B05B 12/122* (2013.01)

(58) Field of Classification Search

USPC ..... 118/323, 321, 712, 713; 427/8

See application file for complete search history.

(56) References Cited

U.S. PATENT DOCUMENTS

| | | | | |
|---|---|---|---|---|
| 3,797,744 | A * | 3/1974 | Smith | A61L 2/18 134/102.2 |
| 6,346,150 | B1 * | 2/2002 | Conlin | B25J 17/025 118/326 |
| 2012/0304928 | A1 * | 12/2012 | Koelmel | H01L 21/67115 118/712 |
| 2017/0282202 | A1 * | 10/2017 | Lim | B05B 13/0278 |
| 2019/0106283 | A1 * | 4/2019 | Yamaoka | B65G 47/907 |
| 2019/0160482 | A1 * | 5/2019 | Lim | B25J 11/0085 |

* cited by examiner

*Primary Examiner* — Yewebdar T Tadesse

(57) ABSTRACT

The present disclosure provides a spraying system and a using method thereof. The spraying system includes a lifting apparatus and a spraying apparatus. The spraying apparatus connects to the lifting apparatus and includes a stage, a multi-axis transfer mechanism, a spraying component, a driving component, a surface profile detector, and a controlling component. The multi-axis transfer mechanism is disposed on the stage. The spraying component is disposed on the multi-axis transfer mechanism and the stage. The driving component is disposed on the stage and connects to the lifting apparatus. The surface profile detector is disposed on the stage and scans an area to be sprayed to obtain scanning data. The controlling component is disposed on the stage and controls the lifting apparatus, the spraying component, and the driving component according to the scanning data and pre-stored initial data.

8 Claims, 7 Drawing Sheets

SPRAYING SYSTEM AND USING METHOD THEREOF

CROSS REFERENCE TO RELATED DISCLOSURE

This application claims the priority benefit of Provisional Patent Application Ser. No. 63/062,892, filed on Aug. 7, 2020 and Taiwan Patent Application Number TW110114216, filed on Apr. 20, 2021, the full disclosure of which are incorporated herein by references.

BACKGROUND

Technical Field

The present disclosure relates to the technical field of a spraying apparatus, particularly to a spraying system and a using method thereof.

Related Art

In the prior art, the spraying operation of the outer wall of the building is usually carried out by manpower. Operators climb on the outer wall of the building by a lifting stage, a hanging cage, or a scaffold to perform high-altitude operations. In order to ensure the safety of construction, operators must be trained and qualified and have a construction license for high-altitude operations. However, training qualified operators may take a lot of time. Furthermore, even if the operators have qualified licenses, high-altitude operations still have a certain degree of danger. For experienced and skilled operators, the more complicated sprayed patterns still are tests. The problems of the spraying operation are not only that mentioned above, but the difficulty of construction also significantly increases when the outer wall of the building has a complicated shape and structure. Therefore, improving the accuracy and aesthetics of the spraying operation and reducing the high cost and high risk caused by the use of manpower have become urgent issues in the present technical field.

SUMMARY

In order to solve the above technical problems, the present disclosure is implemented as follows.

In the first aspect, the present disclosure provides a spraying system including a lifting apparatus and a spraying apparatus. The spraying apparatus connects to the lifting apparatus and includes a stage, a multi-axis transfer mechanism, a spraying component, a driving component, a surface profile detector, and a controlling component. The multi-axis transfer mechanism is disposed on the stage. The spraying component is disposed on the multi-axis transfer mechanism and the stage. The driving component is disposed on the stage and connects to the lifting apparatus. The surface profile detector is disposed on the stage and scans an area to be sprayed to obtain scanning data. The controlling component is disposed on the stage and controls the lifting apparatus, the spraying component, and the driving component according to the scanning data and pre-stored initial data.

In the second aspect, the present disclosure provides a using method of the spraying system, and the using method is used for the spraying system as the first aspect. The using method includes: establishing initial data corresponding to the area to be sprayed; storing the initial data in the controlling component; scanning the area to be sprayed by the surface profile detector to obtain the scanning data; transmitting the scanning data to the controlling component; and controlling the driving device, the driving component, and the spraying component according to the scanning data and the initial data.

The present disclosure drives the spraying apparatus to move on the outer wall of the building through the lifting apparatus, and the present disclosure adjusts the details of the sprayed pattern according to surface information and distance information of the wall through the surface profile detector and the controlling component of the spraying apparatus. Therefore, a pre-set pattern is finely sprayed on the outer wall. In this way, the problems of the prior art are solved by the present disclosure, and an automatic spraying system with high efficiency, high precision, and high safety is achieved.

BRIEF DESCRIPTION OF THE DRAWINGS

The figures described herein are used to provide a further understanding of the present disclosure and constitute a part of the present disclosure. The exemplary embodiments and descriptions of the present disclosure are used to illustrate the present disclosure and do not limit the present disclosure, in which.

DETAILED DESCRIPTION OF THE EMBODIMENTS

In order to make the objectives, technical solutions, and advantages of the present disclosure clearer, the technical solutions of the present disclosure will be described clearly and completely in conjunction with specific embodiments and the Figures of the present disclosure. Obviously, the described embodiments are only a part of the embodiments of the present disclosure, rather than all the embodiments. Based on the embodiments in the present disclosure, all other embodiments obtained by a person of ordinary skill in the art without creative work fall within the protection scope of this disclosure.

The following description is of the best-contemplated mode of carrying out the present disclosure. This description is made for the purpose of illustrating the general principles of the present disclosure and should not be taken in a limiting sense. The scope of the present disclosure is best determined by reference to the appended claims.

Moreover, the terms "include", "contain", and any variation thereof are intended to cover a non-exclusive inclusion. Therefore, a process, method, object, or device that comprises a series of elements not only includes these elements, but also comprises other elements not specified expressly, or may include inherent elements of the process, method, object, or device. If no more limitations are made, an element limited by "include a/an . . . " does not exclude other same elements existing in the process, the method, the article, or the device which comprises the element.

Figure 1:
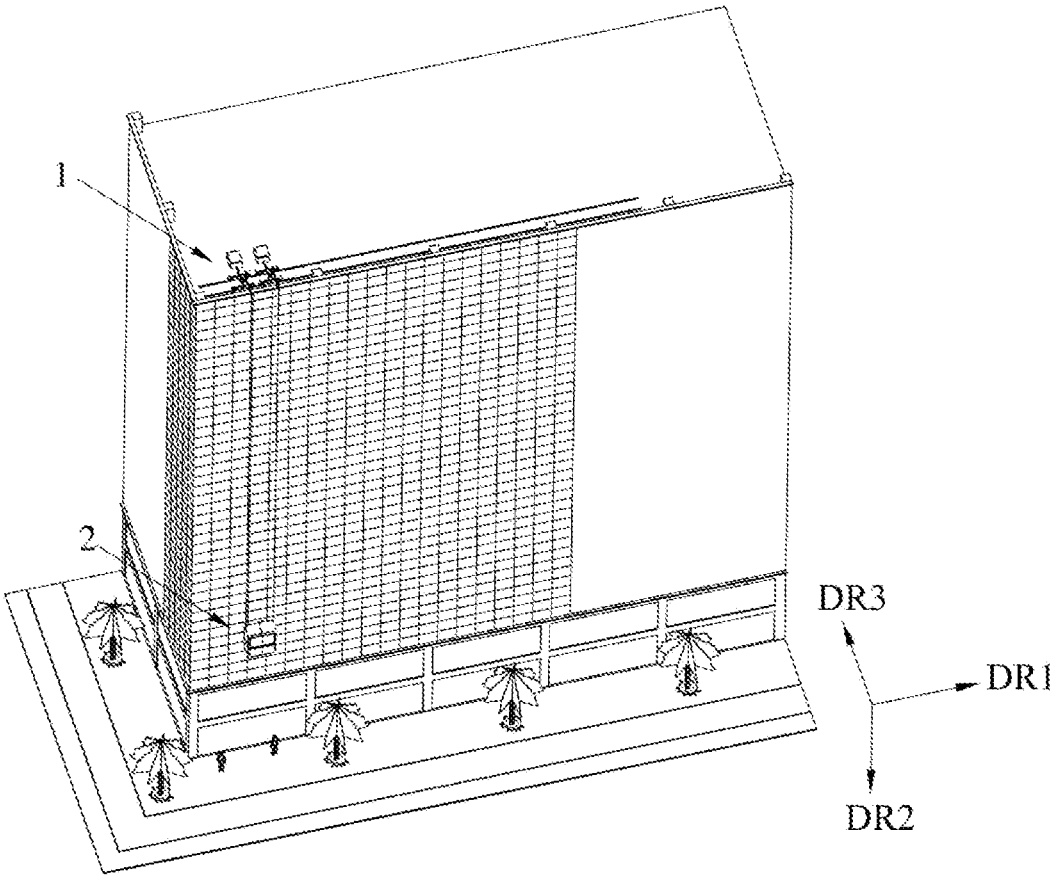
FIG. 1 is a schematic diagram of the spraying system according to an embodiment of the present disclosure.

FIG. 1 is a schematic diagram of the spraying system according to an embodiment of the present disclosure. As shown in the figure, the spraying system includes a lifting apparatus 1 and a spraying apparatus 2. Wherein, the lifting apparatus 1 is used to drive the spraying apparatus 2 to move. The lifting apparatus 1 may be disposed on a roof of the building and connects to the spraying apparatus 2. In this way, the spraying apparatus 2 may be hung on an outer wall of the building by the lifting apparatus 1 and driven by the lifting apparatus 1 to spray various positions of the building. In actual applications, the spraying system of the present disclosure may be widely applied to outer walls of completed buildings, such as flat RC walls, steel-mesh grouted walls, or any suitable flat walls.

Figure 2:
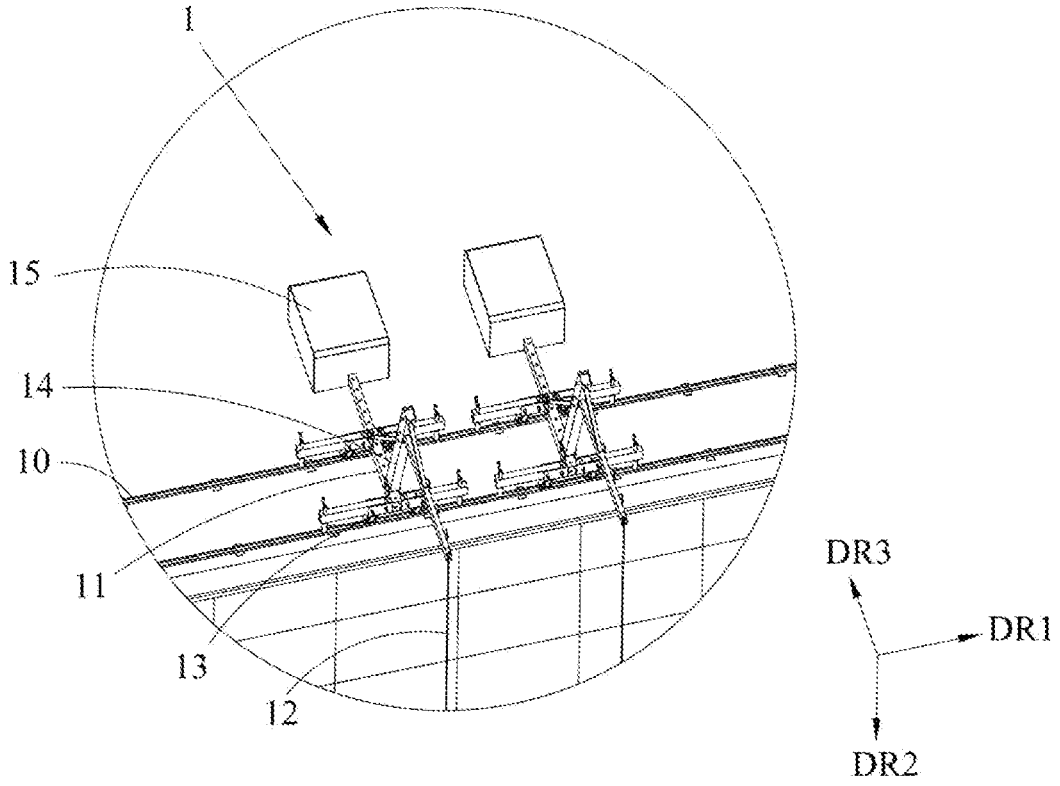
FIG. 2 is a schematic diagram of the lifting apparatus according to an embodiment of the present disclosure.

FIG. 2 is a schematic diagram of a lifting apparatus according to an embodiment of the present disclosure. As shown in the figure, the lifting apparatus 1 includes a sliding rail 10, a support 11, a lifting cable 12, a driving device 13, a positioning device 14, and a counterweight device 15.

The sliding rail 10 extends along a first direction DR1. In the present embodiment, the sliding rail 10 is a double sliding rail type. The double sliding rails are disposed at intervals and arranged in sequence along the edge of the building. However, the present disclosure is not limited thereto. In some embodiments, the sliding rail 10 may also be a single sliding rail type, a triple sliding rail type, or a type with other numbers of slide rails, so as to correspond to different construction environments.

The support 11 is movably disposed on the sliding rail 10. One end of the lifting cable 12 is disposed on the support 11, and the other end of the lifting cable 12 connects to the spraying apparatus 2. Wherein, the lifting cable 12 extends along a second direction DR2. Through the support 11 that may move in the first direction DR1 and the lifting cable 12 that may stretch in the second direction DR2, the spraying apparatus 2 connecting to the lifting cable 12 may be moved on the outer wall of the building. In some embodiments, the lifting cable 12 may be a steel cable or any cable recognized by a person of ordinary skill in the art.

The driving device 13 is disposed on the support 11, and the driving device 13 is used to drive the support 11 to move. In some embodiments, the driving device 13 may be a closed loop motor, such as a stepper motor, a servo motor, or an induction motor, but the present disclosure is not limited thereto. In other embodiments, the driving device 13 may also be an open loop motor and electrically connect to a remote server through wired/wireless communication to receive controlling signals from the remote server.

The positioning device 14 is disposed on the support 11, and the positioning device 14 electrically connects to the driving device 13 to control the driving device 13. For example, a barcode type absolute positioning device or a laser reflector positioning device may be used as the positioning device 14, therefore precise alignment of the support 11 in the first direction DR1 is achieved.

The counterweight device 15 is disposed on one side of the sliding rail 10 away from the lifting cable 12, and the counterweight device 15 connects to the support 11. The weight of the counterweight device 15 may be adjusted according to the support 11, the components on the support 11, and the spraying apparatus 2 hung on the support 11, so as to have the maximum safety load. By using the counterweight device 15 to balance the weight and absorb the vibration generated by the lifting cable 12 during lifting, the spraying apparatus 2 connecting to the lifting cable 12 may be more stable. Therefore, the construction accuracy of the spraying apparatus 2 may be improved.

Figure 3:
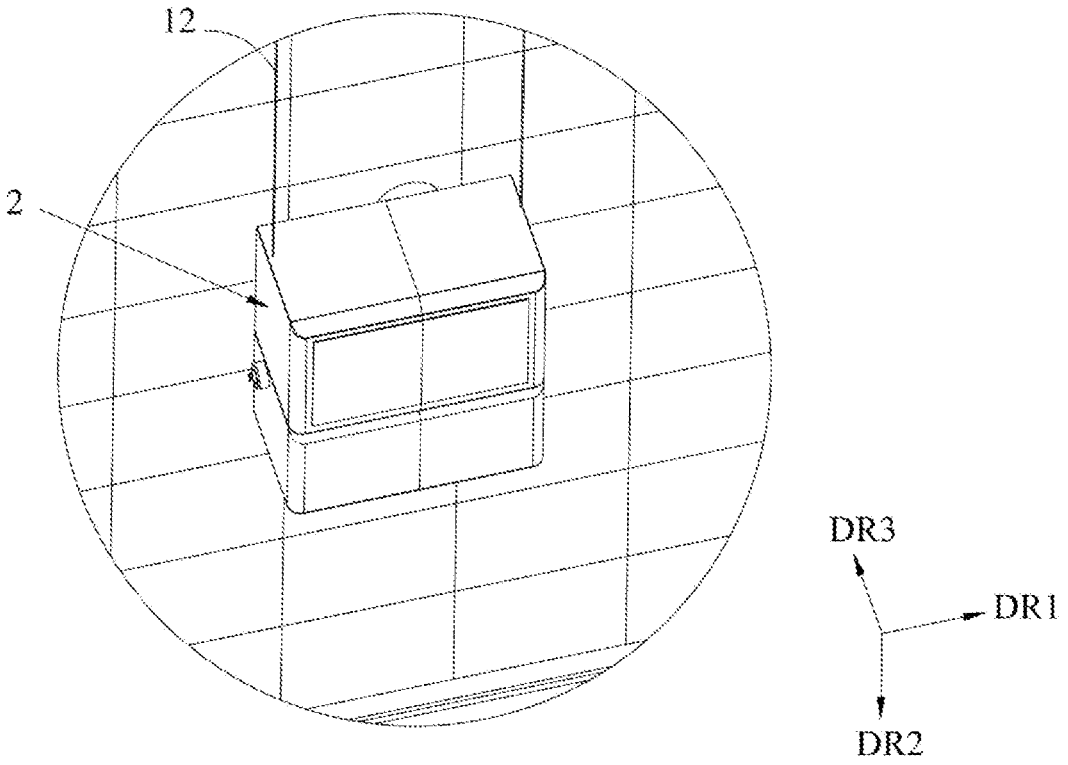
FIG. 3 is a schematic diagram of the spraying apparatus according to an embodiment of the present disclosure.
Figure 4:
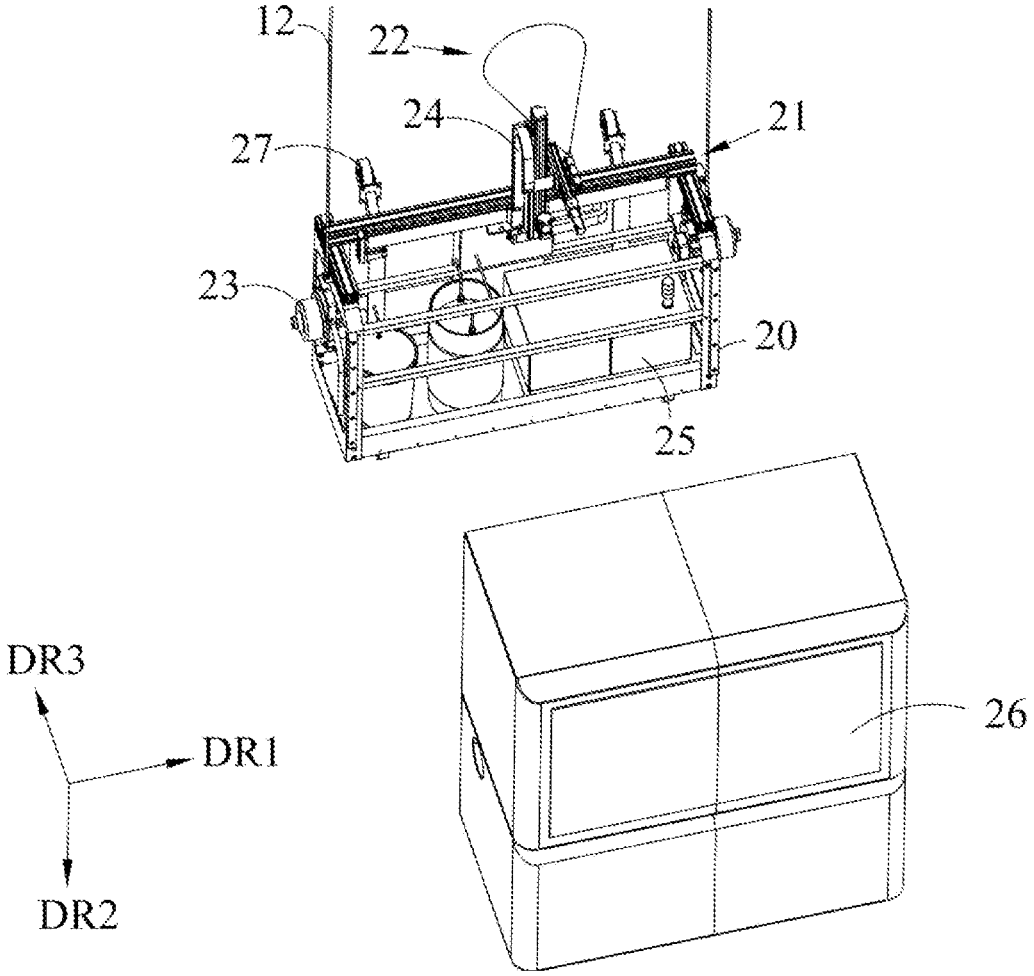
FIG. 4 is an exploded view of the spraying apparatus according to an embodiment of the present disclosure.
Figure 5:
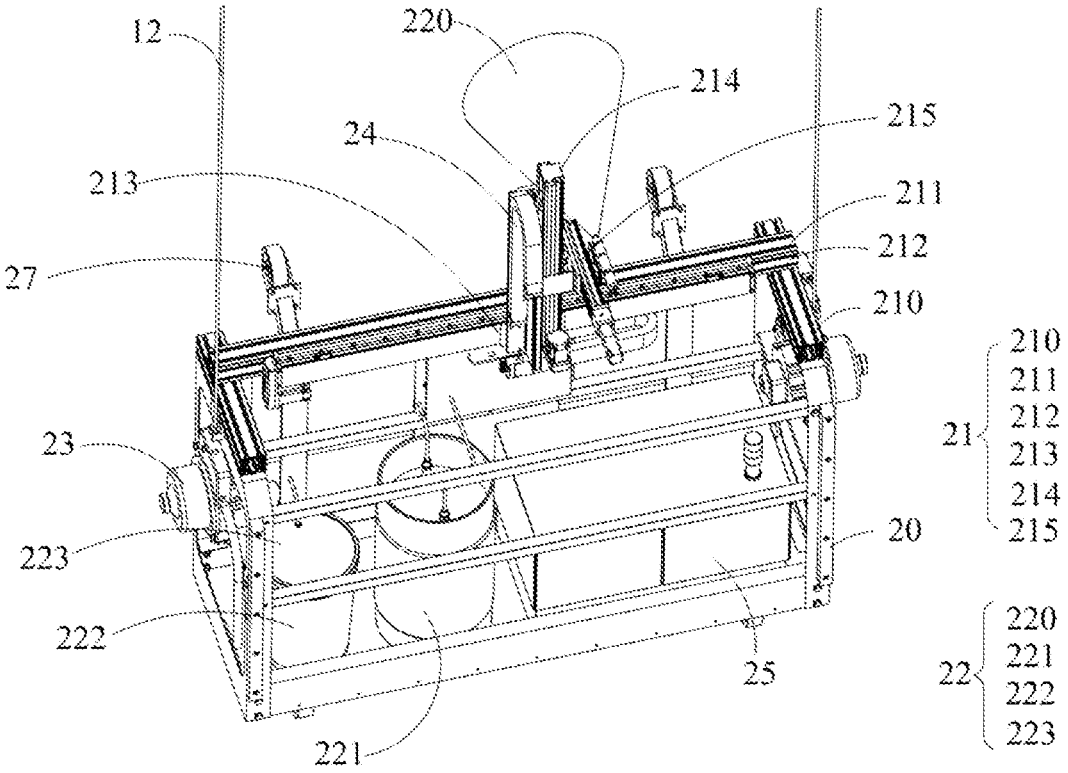
FIG. 5 is an enlarged schematic diagram of a spraying apparatus according to an embodiment of the present disclosure.

FIG. 3 to FIG. 5 respectively are a schematic diagram, an exploded view, and an enlarged schematic diagram of the spraying apparatus according to an embodiment of the present disclosure. As shown in the figure, the spraying apparatus 2 connects to the lifting apparatus 1 and includes a stage 20, a multi-axis transfer mechanism 21, a spraying component 22, a driving component 23, a surface profile detector 24, and a controlling component 25.

The stage 20 connects to the lifting cable 12 of the lifting apparatus 1 through the driving component 23, and the stage 20 is used to carry other components of the spraying apparatus 2. In the present embodiment, the stage 20 connects to the two lifting cables 12, but the disclosure is not limited thereto. In other embodiments, in order to make the force of the stage 20 uniform, the stage 20 may also be hung on the outer wall of the building by four or more lifting cables 12.

The multi-axis transfer mechanism 21 is disposed on the stage 20. In some embodiments, the multi-axis transfer mechanism 21 may include a first sliding rail 210, a first sliding base 211, a second sliding rail 212, a second sliding base 213, a third sliding rail 214, and a third sliding base 215. The first sliding rail 210 is disposed on the stage 20 and extends along a third direction DR3. The first sliding base 211 is movably disposed on the first sliding rail 210. The second sliding rail 212 is disposed on the first sliding base 211 and extends along the first direction DR1. The second sliding base 213 is movably disposed on the second sliding rail 212. The third sliding rail 214 is disposed on the second sliding base 213 and extends along the second direction DR2. The third sliding base 215 is movably disposed on the third sliding rail 214, and a spraying gun 220 of the spraying component 22 is disposed on the third sliding base 215. Through the sliding rails extending in three directions (ie, the first direction DR1, the second direction DR2, and the third direction DR3) and the sliding base disposed on the sliding rails, the spraying gun 220 may be moved in the three directions. Therefore the fine spraying operation is achieved. Wherein, the first direction DR1, the second direction DR2, and the third direction DR3 may be orthogonal to each other, but the present disclosure is not limited thereto.

The spraying component 22 is disposed on the multi-axis transfer mechanism 21 and the stage 20. In some embodiments, the spraying component 22 may include the spraying gun 220, a paint supplying barrel 221, an air pressure barrel 222, and an air pressure controlling unit 223. The spraying gun 220 may be movably disposed on the multi-axis transfer mechanism 21. The paint supplying barrel 221 is disposed on the stage 20 and in fluid communication with the spraying gun 220. The air pressure barrel 222 is disposed on the stage 20 and connects to the spraying gun 220 through a pipe. The air pressure controlling unit 223 is disposed on the stage 20 and electronically controls the air pressure barrel 222. In some embodiments, the air pressure controlling unit 223 may include a meter head and air filter/regulator/lubricator modular (F.R.L. air controlling unit) to control the pressure of the air output from the air pressure barrel 222.

In actual applications, the spraying component 22 may also include other components to achieve paint spraying. For example, the paint used for spraying may be stored in the paint supplying barrel 221. When a liquid level sensing device of the spraying component 22 receives a signal, the paint starts to be sucked by a rotary joint of the suction port of the paint supplying barrel 221. The paint supplying amount is controlled by automatically adjusting a neck of the rotary joint of the suction port, a piston sealing ring, and a compression degree of pressure. Wherein, a service life of the piston sealing ring may be prolonged by the present adjustment method. Then, the paint is delivered through a cylinder pressure. When the liquid level sensing device in the spraying component 22 receives an arriving signal, an air valve connecting to the air pressure barrel 222 is opened to deliver the paint to a delivery pipe used for high-pressure paint spraying. Finally, a transfer valve of the spraying gun 220 is opened to spray the air and paint in the delivery pipe by the spraying gun 220 on the area to be sprayed (that is, the outer wall of the building).

During the spraying process, the ratio of paint to air, the supply of paint, the spraying time, and the spraying distance may be adjusted according to the spraying effect. For example, the spraying distance may be 45-60 cm from the outer wall, but the present disclosure is not limited thereto. When the spraying gun 220 is too close to the outer wall, the spraying operation may be temporarily stopped, and the spraying component 22 may be moved to a safe distance before continuing. It should be noted that the description mentioned above is only an implementation aspect of the present disclosure, and the present disclosure should not be limited thereto. In other embodiments, the spraying component 22 may also be operated in a different method than the method mentioned above.

The driving component 23 is disposed on the stage 20, and the driving component 23 connects to the lifting cable 12 of the lifting apparatus 1. In some embodiments, the driving component 23 may be an asynchronous motor, and the stretch in the second direction DR2 of the lifting cable 12 is controlled by an encoder.

The surface profile detector 24 is disposed on the stage 20, and the surface profile detector 24 scans the area to be sprayed to obtain scanning data. For example, the surface profile detector 23 may be a 3D scanner, which obtains profile data (ie, scanning data) of the outer wall by detection and transmits the data to the controlling component 25.

The controlling component 25 is disposed on the stage 20, and the controlling component 25 electrically connects to the lifting apparatus 1, the spraying component 22, the driving component 23, and the surface profile detector 24. Before construction, the operator may pre-store initial data corresponding to the outer wall structure of the building in the controlling component 25. For example, the relevant parameters of the building (for example, the shape, size, inclination degree, or material of the outer wall) may be established as a model and stored in the controlling component 25. During the spraying process, the controlling component 25 compares the pre-stored initial data with the real-time scanning data to perform corrections for the spraying operation. In other words, the controlling component 25 may control the lifting apparatus 1, the spraying component 22, and the driving component 23 according to the corrections generated from the scanning data and the pre-stored initial data, therefore a highly precise spraying operation is achieved. Wherein, the corrections of the spraying operation may be the distance between the spraying gun 220 and the outer wall (that is, the position on the third direction DR3), the spraying path (that is, the distance in the first direction DR1 and/or the second direction DR2), spraying pressure, spraying amount, spraying angle, and thickness of the spraying film, but the present disclosure is not limited thereto.

In some embodiments, the spraying apparatus 2 may further include a cover 26 disposed on the stage 20 to cover the spraying component 22, the driving component 23, the surface profile detector 24, and the controlling component 25 on the stage 20. The cover 26 may be used for wind protection. Thus, the cover 26 prevents the above components from being interfered by strong winds during high-altitude operations resulting in reducing the accuracy of the operations.

Figure 6:
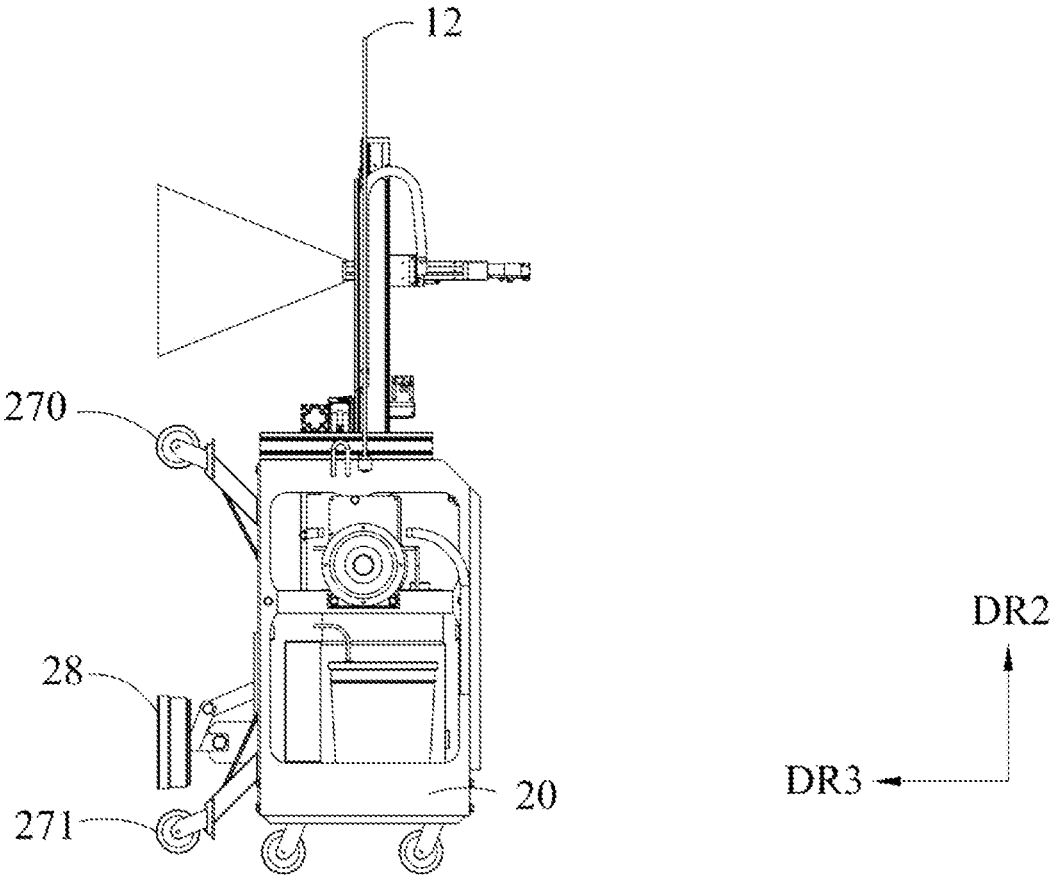
FIG. 6 is a schematic diagram of the elastic component and the suction component according to an embodiment of the present disclosure.

FIG. 6 is a schematic diagram of the elastic component and the suction component according to an embodiment of the present disclosure. As shown in the figure, in some embodiments, the spraying apparatus 2 may further include an elastic component 27 disposed on a side of the stage 20 adjacent to the area to be sprayed. One end of the elastic component 27 is disposed on the stage 20, and the other end abuts against the outer wall of the building. For example, the elastic component 27 may include an upper roller 270 and a lower roller 271. The upper roller 270 and the lower roller 271 are disposed on the side of the stage 20 adjacent to the area to be sprayed. When the stage 20 is moved by the stretch of the lifting cable 12, the friction between the stage 20 and the outer wall may be reduced by the elastic component 27. In addition, when the stage 20 is interfered by strong wind, the positive impact between the stage 20 and the outer wall may also be reduced by the elastic component 27.

In some embodiments, the spraying apparatus 2 may further include a suction component 28 disposed on a side of the stage 20 adjacent to the area to be sprayed. The suction component 28 is used to attach the outer wall of the building, so that the stage 20 may be fixed on the outer wall. In some embodiments, the suction component 28 may be a high-strength suction cup, but the present disclosure is not limited thereto.

Figure 7:
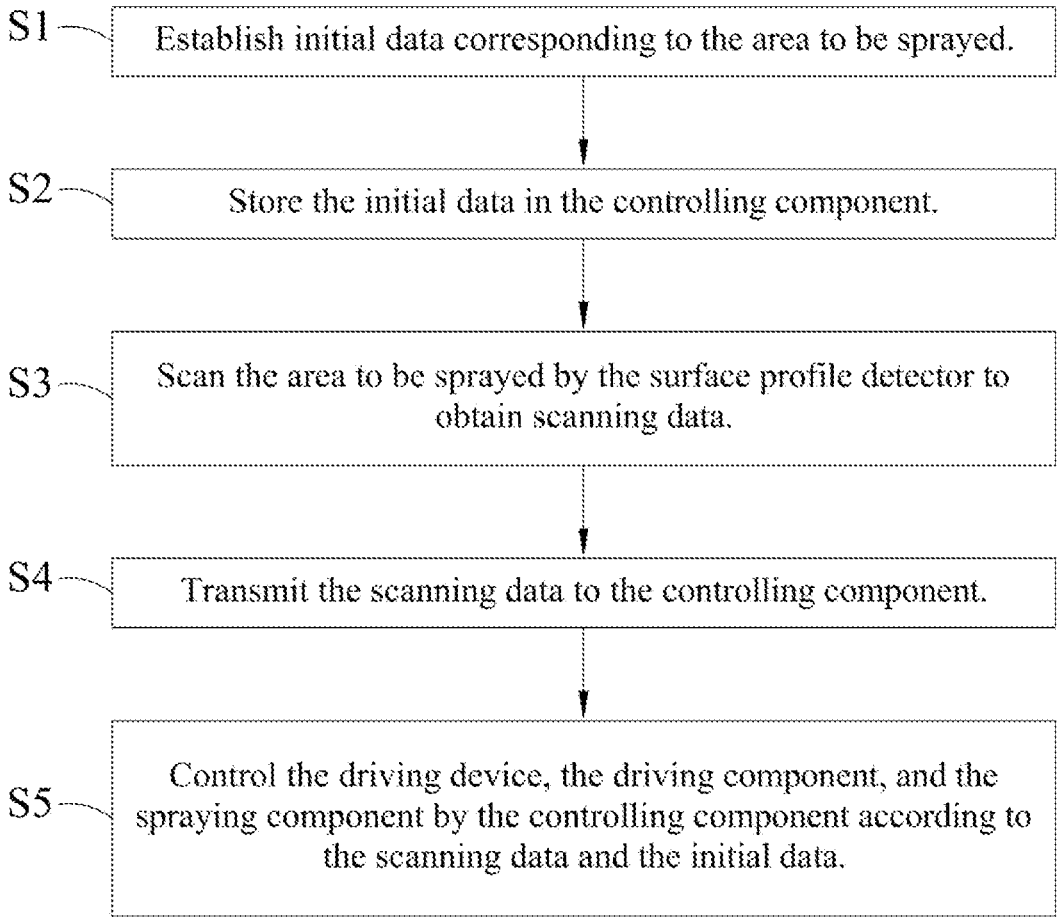
FIG. 7 is a flowchart of the using method of the spraying system according to an embodiment of the present disclosure.

FIG. 7 is a flowchart of the using method of the spraying system according to an embodiment of the present disclosure. As shown in the figure, the using method of the spray system includes:

Step S1: Establish initial data corresponding to the area to be sprayed. Wherein, the establishment of initial data may include confirmation of basic building conditions (outer layer, size, special conditions), confirmation of preliminary graphic, planning drawing, confirmation of proofread simulation drawing, etc.

Step S2: Store the initial data in the controlling component 25.

Step S3: Scan the area to be sprayed by the surface profile detector 24 to obtain the scanning data.

Step S4: Transmit the scanning data to the controlling component 25.

Step S5: Control the driving device 13, the driving component 23, and the spraying component 22 by the controlling component 25 after correcting the data according to the scanning data and the initial data. Wherein, the control of the driving device 13 refers to moving the lifting apparatus 1 in the first direction DR1. The control of the driving component 23 refers to stretching the lifting cable 12 in the second direction DR2. The control of the spraying component 22 includes moving the spraying gun 220 in the first direction DR1, the second direction DR2, and/or the third direction DR3, controlling the spraying angle of the spraying gun 220, controlling the supplying pressure of the paint supplying barrel 221 and the air pressure barrel 222, and fed volume, etc.

In some embodiments, the paint may include one or more of a primer, a surfacer, a stone/fancy paint, and a clear topcoat paint. Preferably, the primer, the surfacer, the stone/fancy paint, and the clear topcoat paint may be applied to the outer wall of the building in sequence. Wherein, the stone/fancy paint may be sprayed by a large-capacity pressure barrel, an airless sprayer, a high-pressure spraying pipe, a pressure meter head, and a spraying gun apparatus. The primer, surfacer, and clear topcoat paint may be sprayed by a sprayer controlled with pressure, a high-pressure spraying pipe, a pressure meter head, and a spraying gun. It should be noted that the arrangement mentioned above is only an implementation aspect of the present disclosure, and the present disclosure is not limited thereto.

In some embodiments, the spraying path may include three layers. The first layer occupies 50% of the amount of paint, and the applying path thereof is continuous spraying in the vertical direction and the horizontal direction. The second layer occupies 30% to 40% of the amount of paint, and the applying path thereof may be similar or the same as that of the first layer, or may be adjusted with the standard pattern. The third layer is a repair layer occupying 10% to 20% of the amount of paint. The best aspect is that each layer has an overlap area of 10% to 20% to each other, therefore uniformity and integrity of the entire area are achieved.

In some embodiments, when runs appear in the pattern of the fancy paint on the outer wall, the amount of paint is too high. Thus, the pressure of the spraying gun needs to be increased and the supplying pressure needs to be decreased. Conversely, when the pattern of the fancy paint on the outer wall is damaged or atomized, the amount of paint is too low. Thus, the pressure of the spraying gun needs to be decreased and the supplying pressure needs to be increased.

In some embodiments, the angle between the spraying gun 220 and the outer wall may also be adjusted according to actual conditions. For example, the spraying angle may be between 15° and 90°. The preferred spraying angle may be 30°, 45°, 60°, 75°, 90° or a range of any combination of the above values.

In summary, various beneficial effects may be achieved by the spraying system and the using method thereof described above. For example, the pattern to be sprayed is made by a professional drawing staff and is automatically sprayed by the spraying system. As a result, the sprayed pattern has a high degree of integrity and a very low error rate. In addition, the spraying system may continue to work during the construction time, which is more efficient than the manpower that needs to rest. Finally, the use of manpower may be reduced by the spraying system, thus the risk of high-altitude operations may be reduced. Therefore, a high-precision, low-error rate, high-efficiency, and high-safety spraying system and using method thereof are achieved by the present disclosure, so as to solve the problems in the prior art.

A person of ordinary skill in the art will understand current and future manufacturing processes, method and step from the content disclosed in some embodiments of the present disclosure, as long as the current or future manufacturing processes, method, and step performs substantially the same functions or obtain substantially the same results as the present disclosure. Therefore, the scope of the present disclosure includes the above-mentioned manufacturing process, method, and steps.

The above descriptions are only examples of this application and are not intended to limit this application. This disclosure may have various modifications and changes for a person of ordinary skill in the art. Any modification, equivalent replacement, improvement, etc. made within the spirit and principle of this application shall be included in the scope of the claims of this disclosure.

What is claimed is:

1. A spraying system, comprising:
- a lifting apparatus; and
- a spraying apparatus connecting to the lifting apparatus, wherein the spraying apparatus comprises:
  - a stage;
  - a multi-axis transfer mechanism disposed on the stage, wherein the multi-axis transfer mechanism comprises:
    - a first sliding rail disposed on the stage, wherein the first sliding rail extends along a third direction;
    - a first sliding base movably disposed on the first sliding rail;
    - a second sliding rail disposed on the first sliding base, wherein the second sliding rail extends along a first direction;
    - a second sliding base movably disposed on the second sliding rail;
    - a third sliding rail disposed on the second sliding base, wherein the third rail extends along a second direction; and
    - a third sliding base movably disposed on the third sliding rail;
  - a spraying component disposed on the multi-axis transfer mechanism and the stage, wherein the spraying component is disposed on the third sliding base;
  - a driving component disposed on the stage, wherein the driving component connects to the lifting apparatus;
  - a surface profile detector disposed on the stage, wherein the surface profile detector scans an area to be sprayed to obtain scanning data; and
  - a controlling component disposed on the stage, wherein the controlling component controls the lifting apparatus, the spraying component, and the driving component according to the scanning data and pre-stored initial data.

2. The spraying system according to claim 1, wherein the lifting apparatus comprises:
- a sliding rail extending along the first direction;
- a support movably disposed on the sliding rail;
- a lifting cable, wherein one end of the lifting cable is disposed on the support, the other end of the lifting cable connects to the driving component of the spraying apparatus, and the lifting cable extends along the second direction;
- a driving device disposed on the support, wherein the driving device drives the support to move;
- a positioning device disposed on the support, wherein the positioning device electrically connects to the driving device to control the driving device; and
- a counterweight device disposed on a side of the sliding rail away from the lifting cable, wherein the counterweight device connects to the support.

3. The spraying system according to claim 1, wherein the spraying component comprises:
- a spraying gun movably disposed on the multi-axis transfer mechanism;
- a paint supplying barrel disposed on the stage, wherein the paint supplying barrel is in fluid communication with the spraying gun;
- an air pressure barrel disposed on the stage, wherein the air pressure barrel is in fluid communication with the spraying gun; and an air pressure controlling unit disposed on the stage, wherein the air pressure controlling unit electrically connects to the air pressure barrel.

4. The spraying system according to claim 1, wherein the spraying apparatus further comprises a cover disposed on the stage to cover the spraying component, the driving component, the surface profile detector, and the controlling component on the stage.

5. The spraying system according to claim 1, wherein the spraying apparatus further comprises an elastic component disposed on one side of the stage adjacent to the area to be sprayed.

6. The spraying system according to claim 5, wherein the elastic component comprises an upper roller and a lower roller, and the upper roller and the lower roller are disposed on one side of the stage adjacent to the area to be sprayed.

7. The spraying system according to claim 5, wherein the spraying apparatus further comprises a suction component disposed on a side of the stage adjacent to the area to be sprayed.

8. A using method for the spraying system according to claim 1, comprising:

establishing initial data corresponding to the area to be sprayed;

storing the initial data in the controlling component;

scanning the area to be sprayed by the surface profile detector to obtain the scanning data;

transmitting the scanning data to the controlling component; and controlling the driving device, the driving component, and the spraying component according to the scanning data and the initial data.

* * * * *